US005755192A

United States Patent [19]

Brevick

[11] Patent Number: 5,755,192

[45] Date of Patent: May 26, 1998

[54] VARIABLE COMPRESSION RATIO PISTON

[75] Inventor: John Edward Brevick, Livonia, Mich.

[73] Assignee: Ford Global Technologies, Inc., Dearborn, Mich.

[21] Appl. No.: 784,888

[22] Filed: Jan. 16, 1997

[51] Int. Cl.[6] ..... F02B 75/04

[52] U.S. Cl. ..... 123/78 B; 92/215; 92/256

[58] Field of Search ..... 92/255, 256, 215, 92/84, 82; 123/48 B, 78 B, 193.6

[56] References Cited

U.S. PATENT DOCUMENTS

| | | | |
|---|---|---|---|
| 1,252,269 | 1/1918 | Johnson | 123/78 B |
| 2,170,266 | 8/1939 | Leissner . | |
| 2,376,214 | 5/1945 | Webster | 92/256 |
| 2,446,348 | 8/1948 | Webster | 92/215 |
| 3,450,111 | 6/1969 | Cronstedt . | |
| 3,934,560 | 1/1976 | Dodd . | |
| 4,016,841 | 4/1977 | Karaba et al. . | |
| 4,510,895 | 4/1985 | Slee . | |
| 5,476,074 | 12/1995 | Boggs et al. . | |

FOREIGN PATENT DOCUMENTS

| | | | |
|---|---|---|---|
| 994044 | 11/1951 | France | 123/78 B |
| 1153247 | 3/1958 | France | 123/78 B |
| 1153247 | 3/1960 | France . | |
| 1217378 | 5/1960 | France . | |
| 401855 | 2/1943 | Italy | 123/78 B |
| 553347 | 4/1977 | U.S.S.R. | 123/78 B |
| 7169 | 3/1907 | United Kingdom . | |
| 235676 | 6/1925 | United Kingdom | 123/78 B |

*Primary Examiner*—Thomas E. Denion
*Attorney, Agent, or Firm*—Jerome R. Drouillard

[57] ABSTRACT

A piston for an internal combustion engine has a trunk portion and a crown portion slidably mounted above the trunk portion. The entirety of the trunk portion extends above the piston's wrist pin bore. A resilient element positioned the crown portion with respect to the trunk portion with sufficient force in a direction tending to separate the crown portion and trunk portion such that the crown portion will be placed in a position of maximum extension during at least some part of the combustion cycle.

1 Claim, 4 Drawing Sheets

VARIABLE COMPRESSION RATIO PISTON

BACKGROUND OF THE INVENTION

1. Field of the Invention

The present invention relates to a piston for an internal combustion engine in which the compression length of the piston may change while the engine is operating, such as to achieve an adjustable compression ratio.

2. Discussion of Related Art

Variable compression ratio pistons having variable compression height, defined herein as the distance from the uppermost portion of the piston to the center of the wrist pin, have been the subject of inventions for a considerable period of time. French patent document 1,153,247 discloses two embodiments of variable compression ratio pistons. These embodiments suffered from several drawbacks. First, the pistons are of massive construction. Indeed, in one embodiment of French '247, the displaceable portion of the piston comprises the entire outer portion of the piston, which would be expected to be quite heavy and therefore unsuitable for use in modern high-speed engines. A second embodiment, FIG. 2 of French '247, discloses a variable compression ratio piston having springs which urge the upper part of the piston away from the lower part of the piston. Unfortunately, the majority of the piston rings are installed on a lower part of the piston, with only a single piston ring on the upper portion of the piston. This design would be unstable and prone to excessive emissions of unburned hydrocarbons, arising from the propensity of unburned gases to become trapped in the portion of the piston underlying the top piston ring. This crevice volume problem is assiduously avoided by piston designers.

British patent document 7169 discloses another spring-driven variable compression ratio piston having the problem of the displaceable portion comprising the entire outer casing of the piston, which, of course, as described above, impairs high-speed operation of the device. Of course, in the first decade of this century, high-speed operation was not a consideration for internal combustion engines.

A piston according to the present invention solves the problems of the prior art variable compression ratio pistons while allowing use of such a device in modern high-speed reciprocating internal combustion engines.

SUMMARY OF THE INVENTION

A piston for an internal combustion engine having at least one cylinder has a connecting rod upon which the piston is mounted for reciprocation within at least one engine cylinder. The piston includes a trunk portion having a wrist pin bore for receiving a wrist pin so as permit connection of the piston with the connecting rod and a crown portion slidably mounted upon the trunk portion, with the entirety of the crown portion extending above the wrist pin bore. A plurality of piston rings is mounted upon the crown portion. A resilient element positions the crown portion with respect to the trunk portion. The resilient element exerts sufficient force in a direction tending to the separate the crown portion and the trunk portion such that the crown portion will be placed in a position of maximum extension during at least some part of the each combustion cycle. The resilient element may comprise a conical, or Belleville washer extending between an interior surface of the crown portion and an upper surface of the trunk portion. Alternatively, the resilient element may comprise an annular spring extending between an interior surface of the crown portion and an upper surface of the trunk portion. The resilient element may further comprise a combination of an annular spring extending between an interior surface of the crown portion and an upper surface of the trunk portion, and a pneumatic spring positioned between the crown portion and trunk portion.

As yet another alternative, the pneumatic spring may be supplanted by a plastic foam spring positioned between the crown portion and the trunk portion.

In order to protect against excessive impact or shock loading when the trunk and crown portions come together, as when the combustion pressure increases beyond a threshold level, a resilient buffer may be interposed between an annular lower surface of the crown portion and a corresponding upper surface of the trunk portion. The crown portion may be retained upon the trunk portion by an internal snap ring fitted into a groove formed in an inner cylindrical wall of the crown portion, with the snap ring engaging a groove formed in an outer cylindrical surface of the trunk portion. If desired, the internal snap ring may have a wave configuration so as to provide resilient resistance to unacceptable shock created when the trunk and crown portions telescopically move together.

The resilient element positioned between the trunk and crown portions of the piston according to the present invention may comprise a hydraulic chamber defined by interior roof and wall surfaces of the crown portion and an upper surface of the trunk portion, with the hydraulic chamber being furnished with engine lubricating oil by means of the passage formed in the connecting rod. Flow of oil into and out of the hydraulic chamber may be controlled by a plurality of valves, with at least one valve for allowing flow into the hydraulic chamber and at least one valve for allowing flow out of the hydraulic chamber. The valves may be sized such that movement of the crown portion relative to the trunk portion may be damped by the pressure of the oil which is moving through the valves. In any event, the hydraulic damping element will be located above the wrist pin bore.

It is an advantage of a piston according to the present invention that variable compression may be achieved without resort to heavy, more complicated structures.

It is another advantage of the present invention that the present piston may be used in modern, high speed internal combustion engines.

DESCRIPTION OF THE PREFERRED EMBODIMENTS

Figure 1:
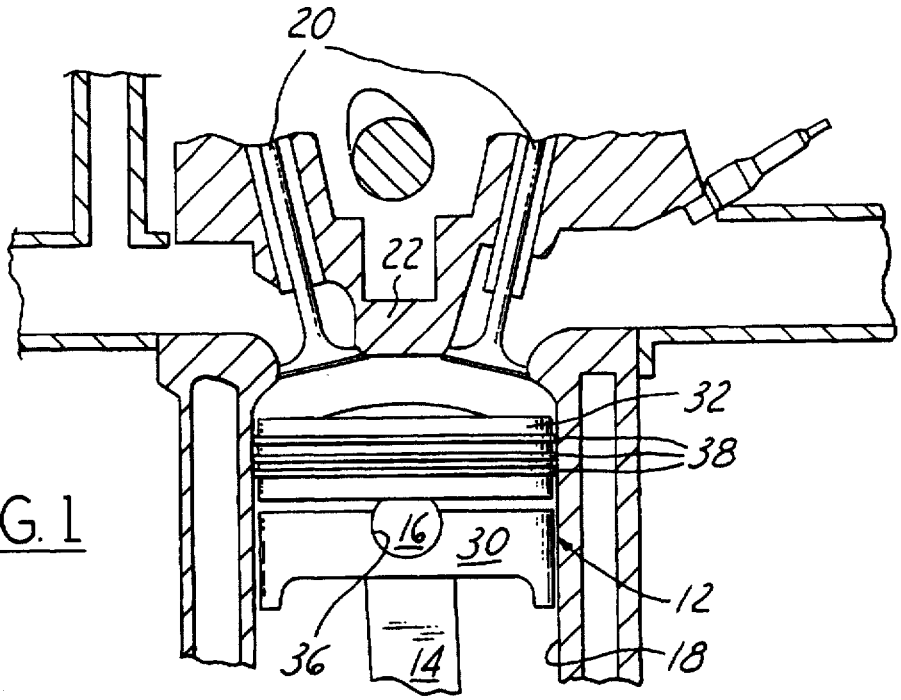
FIG. 1 is a schematic representation of an engine having a piston according to the present invention.

As shown in FIG. 1, piston 12 is intended to be attached to connecting rod 14 via wrist pin 16, which is housed in wrist-pin bore 36. Of course, piston 12 is reciprocably mounted within engine cylinder 18. Air enters the cylinder and exhaust exits by means of valves 20 in accordance with usual automotive practice, with both valves 20 being mounted within cylinder head 22. Those skilled in the art will appreciate in view of this disclosure that a piston according to the present invention could be employed with either 2 stroke or 4 stroke cycle spark ignited or compression ignition engines.

As shown in the various figures, a plurality of piston rings 38 is mounted within a plurality of piston ring grooves 40 which are all contained within the crown portion 32 of piston 12. This is significant because if any of the piston rings are mounted below crown portion 32, the role played by the piston in controlling hydrocarbon emissions, which are regulated throughout most of the world today, will be impaired. Another advantage of the present piston is the fact that prior art designs which included a full outer shell telescopically mounted upon an inner structure could be expected to have noise problems resulting from slapping of the outer shell upon the mating inner surfaces. Mounting all of the piston rings upon crown portion 32 also promotes better heat transfer from the piston to the cylinder wall and dynamic system damping.

Figure 2A:
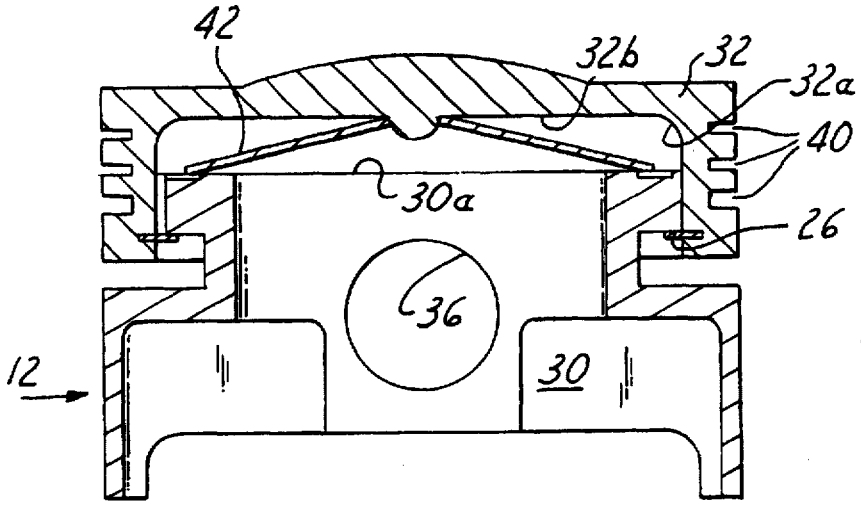
FIGS. 2*a* and 2*b* illustrate a piston according to the present invention in the fully extended and fully retracted positions.
Figure 2B:
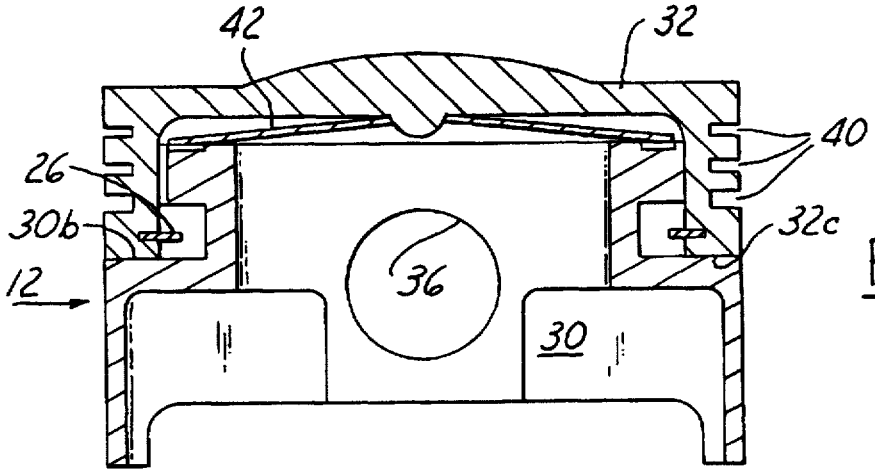
Figure 3:
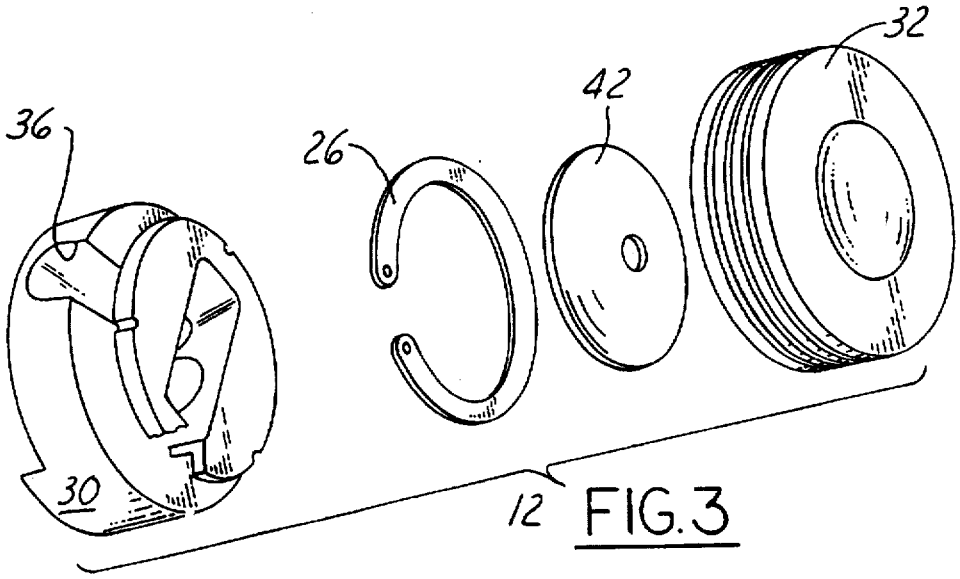
FIG. 3 is a perspective view of a piston according to the present invention showing component parts of one embodiment.
Figure 5:
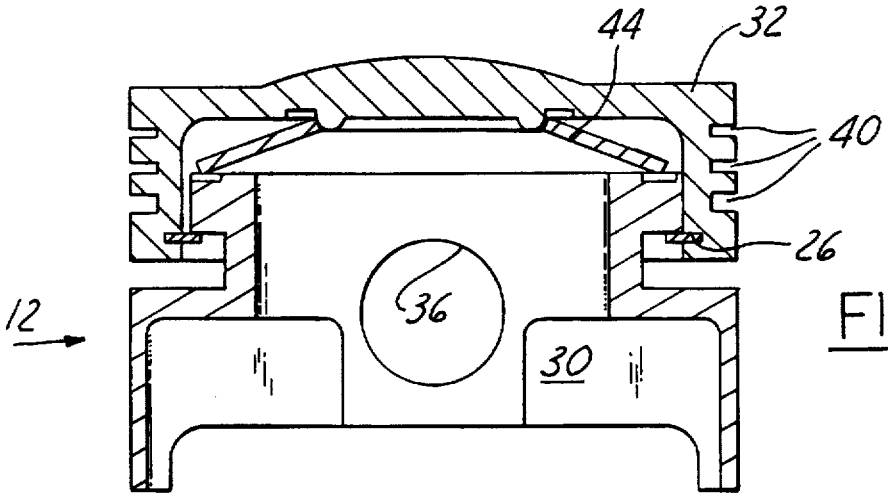
FIGS. 5 and 6 show alternate embodiments of a piston according to the present invention.
Figure 6:
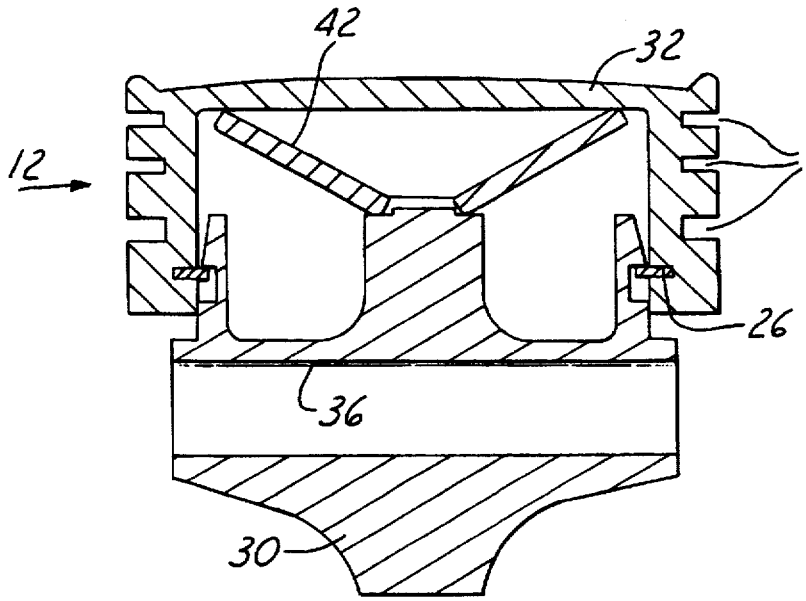

Details of construction of the present piston are shown with particularity in FIGS. 2 and 3. Crown portion 32 has an interior cylindrical wall surface 32*a* and a roof surface 32*b*, as shown in FIG. 2*a*. Surface 32*b* opposes top surface 30*a* of trunk portion 30. Crown portion 32 is slidably mounted upon trunk portion 30.

FIG. 2*a* shows the present piston in its fully extended position at the maximum compression height. In other words, crown portion 32 is the maximum distance from wrist pin bore 36. Notice that Belleville washer 42 is in a relatively extended position. FIG. 2*b* illustrates minimum compression height position in which annular lower surface 32*c* of crown portion 32 abuts upper surface 30*b* of trunk portion 30. As is further shown in FIG. 7, resilient buffer 52 may be interposed between annular lower surface 32*c* and surface 30*b* to avoid impact shock when crown portion 32 and trunk portion 30 move to the minimum compression height position. The spring rate of Belleville washer 42, or for that matter, any resilient element employed in the present piston, may be selected such that crown portion 32 will move to the minimum compression height position when the anticipated maximum cylinder pressure exceeds a predetermined threshold. The threshold value, whether determined experimentally or analytically, may be selected so as to control noise emissions, or peak cylinder pressure. In this manner, the efficiency resulting from a higher compression ratio, may be combined with the knock control available with a lower compression ratio. Thus, the use of expensive, higher octane fuels may be avoided. And, in a diesel engine, structural requirements may be mitigated.

Figure 7:
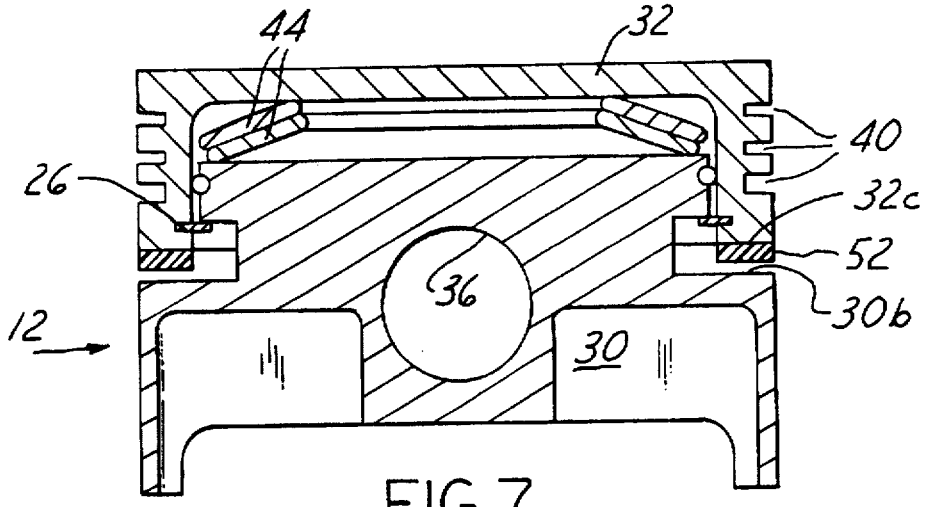
FIG. 7 illustrates a piston according to the present invention having a multipiece annular spring extending between an interior of the crown portion of the piston and the upper surface of the trunk portion.

FIG. 7 illustrates an embodiment in which annular spring 44 has superimposed multiple leaves. Alternatively, a single annular spring leaf could be employed with a piston according to the present invention.

Figure 8:
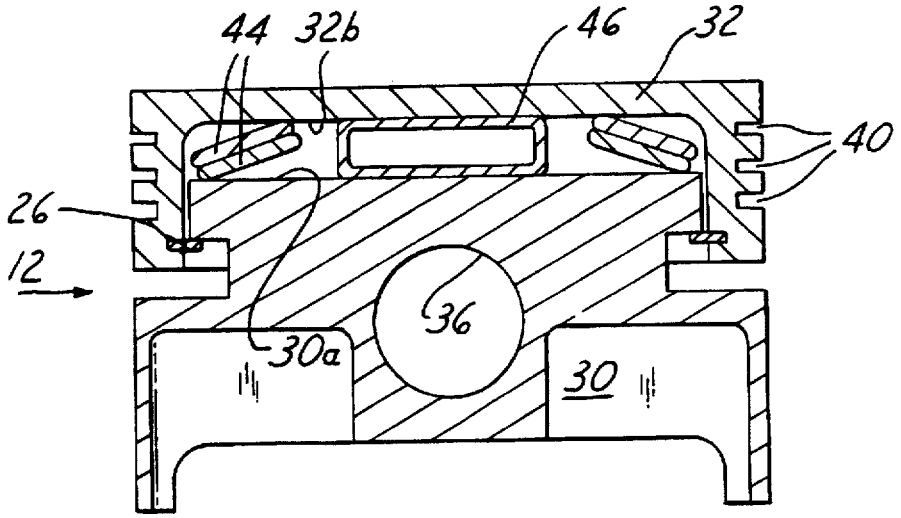
FIG. 8 illustrates a piston according to the present invention having a pneumatic spring and metallic multileaf spring positioned between the trunk and crown portions of the piston.
Figure 9:
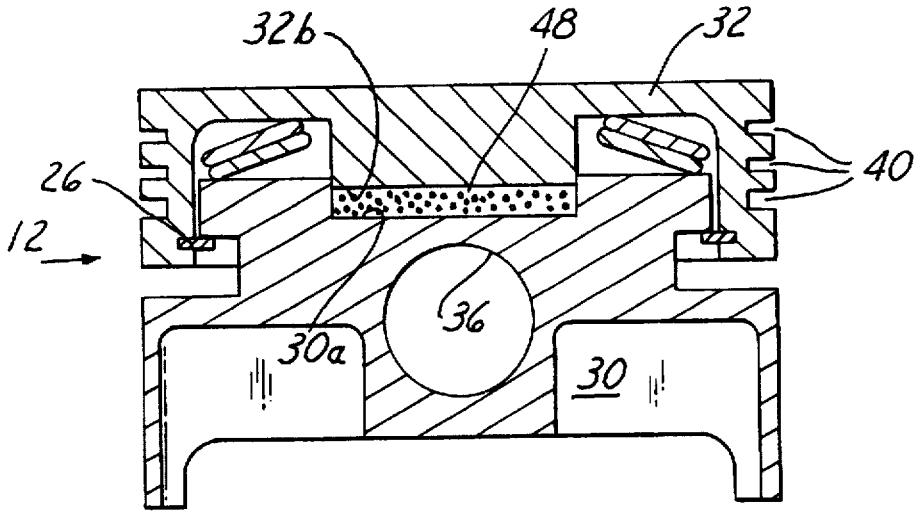
FIG. 9 illustrates a piston according to the present invention having a multileaf spring and a plastic foam spring positioned between the crown and trunk portions of the piston.

FIG. 8 illustrates an embodiment in which pneumatic spring 46 is interposed between roof portion 32*b* of crown portion 32 and upper portion 30*a* of trunk portion 30. FIG. 9 illustrates a case wherein plastic foam spring 48 is interposed between crown portion 32 and trunk portion 30. In either case, the resilient mechanisms work together to urge crown portion 32 to its maximum compression height position.

Figure 4:
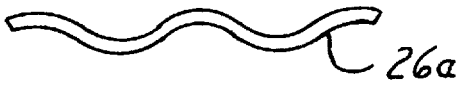
FIG. 4 illustrates a wave-shaped internal snap ring for use with a piston according to the present invention.

FIG. 4 illustrates an alternative embodiment for internal snap ring 26. Thus, ring 26*a* is formed as a wave washer which functions not only as an internal snap ring, but also a damping device to prevent undue shock when the crown portion 32 moves to the maximum compression height position in response to inertia force during some portion of the combustion cycle. As described above, the maximum compression height position is characterized by maximum separation between crown portion 32 and trunk portion 30.

Figure 10:
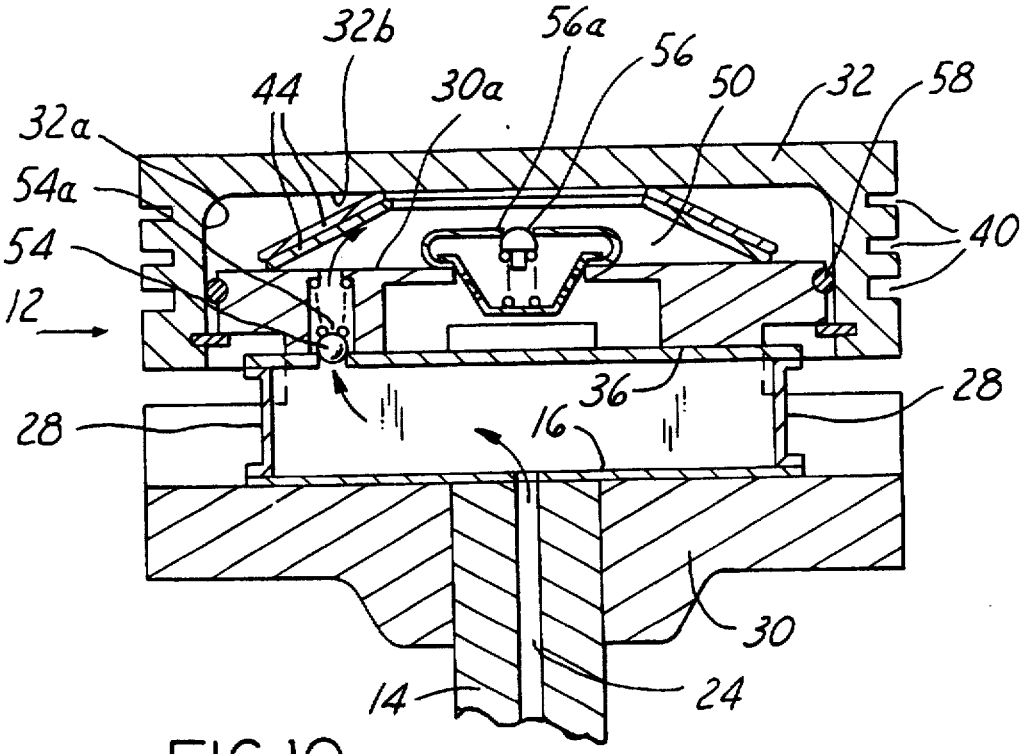
FIG. 10 illustrates a piston according to the present invention having a multileaf spring and a hydraulic damping element positioned between the crown and trunk portions of the piston.

FIG. 10 illustrates another embodiment according to the present invention in which a hydraulic chamber defined by surfaces 32*a* and 32*b* of crown portion 32 and upper surface 30*a* of trunk portion 30 form a hydraulic chamber which is furnished with engine oil by means of passage 24 formed in connecting rod 14. Oil moving up from the lower end of connecting rod 14 (not shown) through drilled passage 24 moves through the interior of wrist pin 36, which is sealed by plugs 28, and then through first check valve 54, which admits oil into the previously described chamber which is labeled 50. Oil trapped in chamber 50 is permitted to leave the chamber via valve 56 when crown portion 32 slides or moves from a position relatively farther from trunk portion 30 to a position relatively closer to the trunk portion. Valves 54 and 56 have associated orifices 54*a* and 56*a* which are sized such that movement of crown portion 32 with respect to trunk portion 30 will be damped. In this manner, a piston according to the present invention may have a plurality of operating points between fully extended to maximum compression height and fully retracted and minimum compression height, because removal of oil from chamber 50 may be controlled on a time dependent basis by proper sizing of orifices 54*a* and 56*a* and tuning of valves 54 and 56.

While the invention has been shown and described in its preferred embodiments, it will be clear to those skilled in the arts to which it pertains that many changes and modifications may be made thereto without departing from the scope of the invention.

I claim:

1. A piston for an internal combustion engine having at least one cylinder, and with the piston being mounted on a connecting rod for reciprocation within said at least one cylinder, with said piston comprising:

a trunk portion having a wrist pin bore for receiving a wrist pin so as to permit connection of the piston with the connecting rod;

a crown portion slidably mounted upon the trunk portion with the entirety of the crown portion extending above the wrist pin bore, wherein said crown portion is retained upon said trunk portion by a wave shaped internal snap rind fitted into a groove formed in an inner cylindrical wall of the crown portion with the snap rind engaging a groove formed in an outer generally cylindrical surface of the trunk portion such that the snap ring will resiliently resist inertial force tending to move the crown portion away from the trunk portion;

a plurality of piston rings mounted upon the crown portion; and a resilient element for positioning the crown portion with respect to the trunk portion with said resilient element exerting sufficient force in a direction tending to separate the crown portion and the trunk portion such that the crown portion will be placed in a position of maximum extension during at least some part of each combustion cycle.

* * * * *